US010548435B2

(12) United States Patent
Wise

(10) Patent No.: US 10,548,435 B2
(45) Date of Patent: Feb. 4, 2020

(54) SOLUTION DISPENSING DEVICE

(71) Applicant: Robert Wise, Penngrove, CA (US)

(72) Inventor: Robert Wise, Penngrove, CA (US)

( * ) Notice: Subject to any disclaimer, the term of this patent is extended or adjusted under 35 U.S.C. 154(b) by 0 days.

(21) Appl. No.: 16/539,323

(22) Filed: Aug. 13, 2019

(65) Prior Publication Data

US 2019/0357735 A1 Nov. 28, 2019

Related U.S. Application Data

(63) Continuation-in-part of application No. 15/483,021, filed on Apr. 10, 2017, now abandoned.

(51) Int. Cl.
*A47K 5/12* (2006.01)

(52) U.S. Cl.
CPC ..... *A47K 5/12* (2013.01)

(58) Field of Classification Search
CPC ..... A47K 5/12; A47K 5/1207; A47K 5/1202; A47K 5/1217; G08B 21/245
See application file for complete search history.

(56) References Cited

U.S. PATENT DOCUMENTS 3,865,271 A * 2/1975 Gold ..... A47K 10/32 221/96
4,921,150 A * 5/1990 Lagergren ..... A47K 5/1215 137/624.11
5,397,028 A 3/1995 Jesadanont
5,435,465 A * 7/1995 El-Amin ..... A47K 5/1204 222/108
5,595,324 A * 1/1997 Brown ..... A47K 5/12 222/1
5,887,759 A * 3/1999 Ayigbe ..... A47K 10/32 222/192
6,404,837 B1 * 6/2002 Thompson ..... A47K 5/1208 377/13
7,611,030 B2 * 11/2009 Reynolds ..... A47K 5/1217 222/1
8,020,734 B1 * 9/2011 Vandendries ..... A47K 5/1217 222/181.3
9,586,217 B2 3/2017 Arminak
(Continued)

*Primary Examiner* — Gene O Crawford
*Assistant Examiner* — Ayodeji T Ojofeitimi
(74) *Attorney, Agent, or Firm* — Global Intellectual Property Agency, LLC; Daniel Boudwin

(57) ABSTRACT

A solution dispensing device including a housing that has an interior volume. The housing holds a solution reservoir and an actuator body that is movably mounted to the housing. The actuator body is operably connected to a dispensing assembly. The dispensing assembly includes a solution chamber disposed within the actuator body. The solution chamber has an interior volume with a first inlet and a first outlet. The first outlet is in fluid communication with a dispensing passageway. When in the dispensing position the actuator body is moved toward a surface of a material positioned adjacent the dispensing passageway. A material sensing trigger is connected to the actuator body and the trigger is configured to sense a targeted material by pressing against the material. The material sensing trigger is further configured to allow the dispensing assembly to dispense a measured amount of solution onto the targeted material through the dispensing passageway.

20 Claims, 11 Drawing Sheets

(56) References Cited

U.S. PATENT DOCUMENTS

2004/0226962 A1* 11/2004 Mazursky ..... A47K 5/1217 222/95
2006/0175341 A1 8/2006 Rodrian
2007/0131715 A1* 6/2007 Minard ..... B67D 1/0044 222/145.5
2009/0008408 A1* 1/2009 Ophardt ..... A47K 5/1217 222/1
2009/0140004 A1* 6/2009 Scorgie ..... A47K 5/1217 222/52
2009/0266842 A1* 10/2009 Snodgrass ..... A47K 5/1202 222/52
2009/0308887 A1* 12/2009 Woo ..... A47K 5/1215 222/52
2010/0012679 A1* 1/2010 Brownlee ..... A47K 5/1217 222/52
2010/0025427 A1* 2/2010 Chiou ..... B65D 83/262 222/1
2010/0051640 A1* 3/2010 Chen ..... A47K 5/1209 222/52
2010/0219206 A1* 9/2010 Ophardt ..... A47K 5/1207 222/192
2010/0288788 A1* 11/2010 Ophardt ..... A47K 5/1207 222/1
2011/0017769 A1* 1/2011 Ophardt ..... A47K 5/1217 222/1
2011/0108410 A1* 5/2011 Ophardt ..... A47K 5/1207 204/157.44
2012/0048891 A1* 3/2012 Hagleitner ..... A47K 5/16 222/52
2013/0001241 A1* 1/2013 Ophardt ..... A47K 5/1217 222/1
2013/0018506 A1* 1/2013 Cittadino ..... A47K 5/1202 700/240
2013/0119083 A1* 5/2013 Ophardt ..... A47K 5/1204 222/64
2013/0299518 A1* 11/2013 McNulty ..... A47K 5/14 222/190
2014/0197196 A1* 7/2014 Tederous ..... A47K 5/1208 222/52
2014/0217123 A1* 8/2014 Ophardt ..... A47K 5/1207 222/190
2015/0272404 A1* 10/2015 Jeon ..... A47K 10/32 222/173
2015/0342421 A1* 12/2015 Harris ..... A47K 5/14 222/190
2016/0249774 A1* 9/2016 Ophardt ..... A47K 5/1205 222/135
2016/0303598 A1 10/2016 Rifkin
2017/0319014 A1* 11/2017 Ophardt ..... A47K 5/1217
2019/0261817 A1* 8/2019 Wertheim ..... B05B 11/00412

* cited by examiner

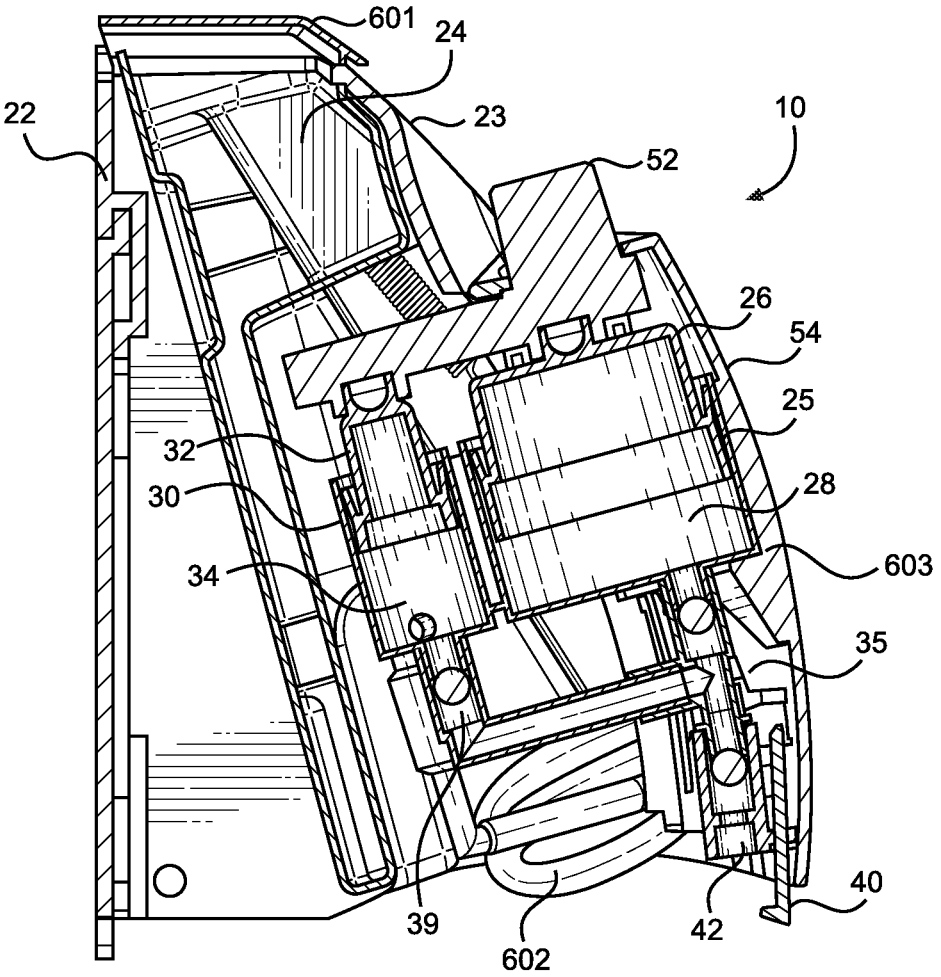
FIG. 6
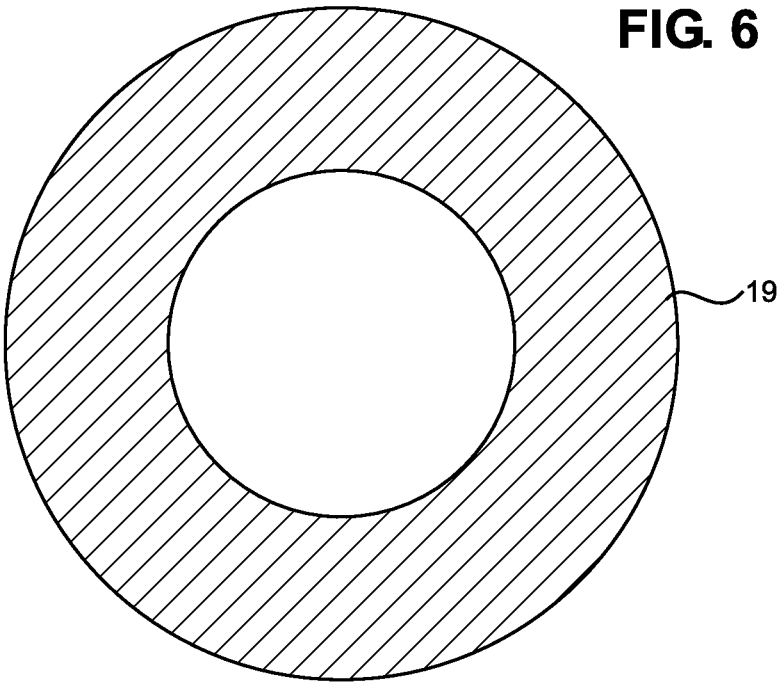

SOLUTION DISPENSING DEVICE

CROSS REFERENCE TO RELATED APPLICATIONS

This application claims the benefit of U.S. application Ser. No. 15/483,021 filed on Apr. 10, 2017. The above identified patent application is herein incorporated by reference in its entirety to provide continuity of disclosure.

BACKGROUND OF THE INVENTION

The present invention relates to solution dispensing devices. More specifically, the present invention relates to solution dispensing devices that are designed for use with solvents and soaps.

Many cleansing and disinfectant solutions, such as hand sanitizing alcoholic solution or traditional soap, are offered in liquid or aqueous form, and are used together with a dispenser designed to easily allow a user to access a small amount of the solution. Such dispensers are commonly found both in a home environment as well as in a professional or clinical setting. Many such dispensers are configured to release the solution in varied amount, dependent on how far a user depresses a lever.

These devices are not designed for use with a cleaning material, such as paper towel or cosmetic wipes, but rather for dispensation directly onto a user's hand. Further, even if a user wished to use such a dispenser with certain material, such as toilet paper, the amount and method of dispensation of the solution would cause the material to disintegrate, rendering the cleansing properties of the solution useless if the task requires such material.

Further, in some situations where water lines are difficult to run or not worth the effort, for example in a temporary bathroom or an outhouse, cleansing products are hard to use. In some instances, the cleansing product that is used, and intended to be water free, does not clean or remove the necessary bacteria. This means that the bacteria is in fact just being rubbed into the users hands further and not actually killed or removed. Usual dispensers, such as antibacterial soaps, containing 60 percent or more of alcohol, rely on this alcohol to dry quick and not require drying towels such as a paper source. Furthermore, these alcohol derived solution dispensers are not variable, dispensing a said amount of solution. Using alcohol based solutions dries out the skin of the user and unlike this dispenser, is not recommended to be used for a user's buttock. This dispenser is engineered to be used with non-toxic biodegradable solution and paper, eliminating the need for woven wet wipes. This solution is then ground into the user's hands along with contaminates, until dried. This is not the best way to thoroughly clean one's hands, soap solutions with some form of drying towel-material, more thoroughly cleans and decontaminate the user's hands.

Accordingly, a device designed to dispense a measured amount of solution, either on its own or aerated with compressed air, that is configured to be dispensed directly only such a material is desired.

SUMMARY OF THE INVENTION

In view of the foregoing disadvantages inherent in the known types of dispensers now present in the prior art, the present invention provides a solution dispensing device wherein the same can be utilized for providing convenience for the user when wishing to dispense solution directly on a targeted material.

The present system comprises a housing having a solution reservoir therein. An actuator is disposed on the housing and is configured to move between a starting position and a dispensing position. In some embodiments, an air chamber is disposed within the housing. When the actuator is engaged and moved toward the dispensing position, a predetermined amount of solution and air is released into a dispensing passageway and onto a targeted material. As the mixture of air and solution combine, a volume of air bubbles is introduced in order to create a foam product that can be dispensed on certain paper goods, such as toilet paper, without causing the paper good to disintegrate. A trigger is installed within the housing that is configured to only release the solution or solution and air mixture when a surface of the targeted material is detected, ensuring that that correct amount of solution is released only when the targeted material is present.

The solution dispensing device is configured to work with various materials, such as toilet paper, paper towels, cosmetic cleansing pads and diaper wipes. This dispensing device works with demising rolls of paper products. Additionally, various types of solutions may be used with the solution dispensing device, such as traditional soaps, hand sanitizer, and cleansing biodiesel.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

FIG. 6 shows a cross sectional view of an embodiment of the solution dispensing device.

DETAILED DESCRIPTION OF THE INVENTION

Figure 1:
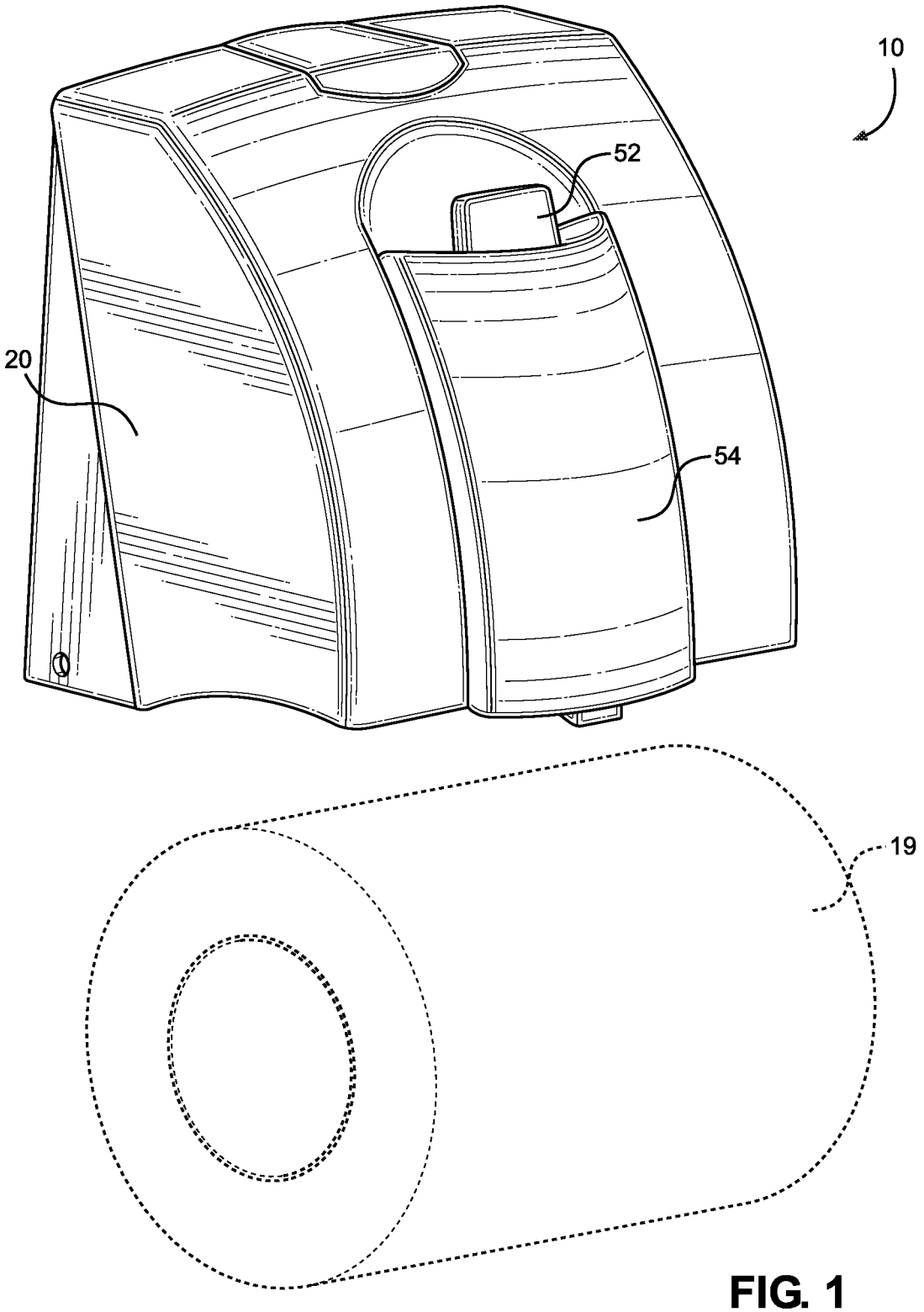
FIG. 1 shows a perspective view of an embodiment of the solution dispensing device.

Reference is made herein to the attached drawings. Like reference numerals are used throughout the drawings to depict like or similar elements of the solution dispensing device. The figures are intended for representative purposes only and should not be considered to be limiting in any respect.

Figure 2A:
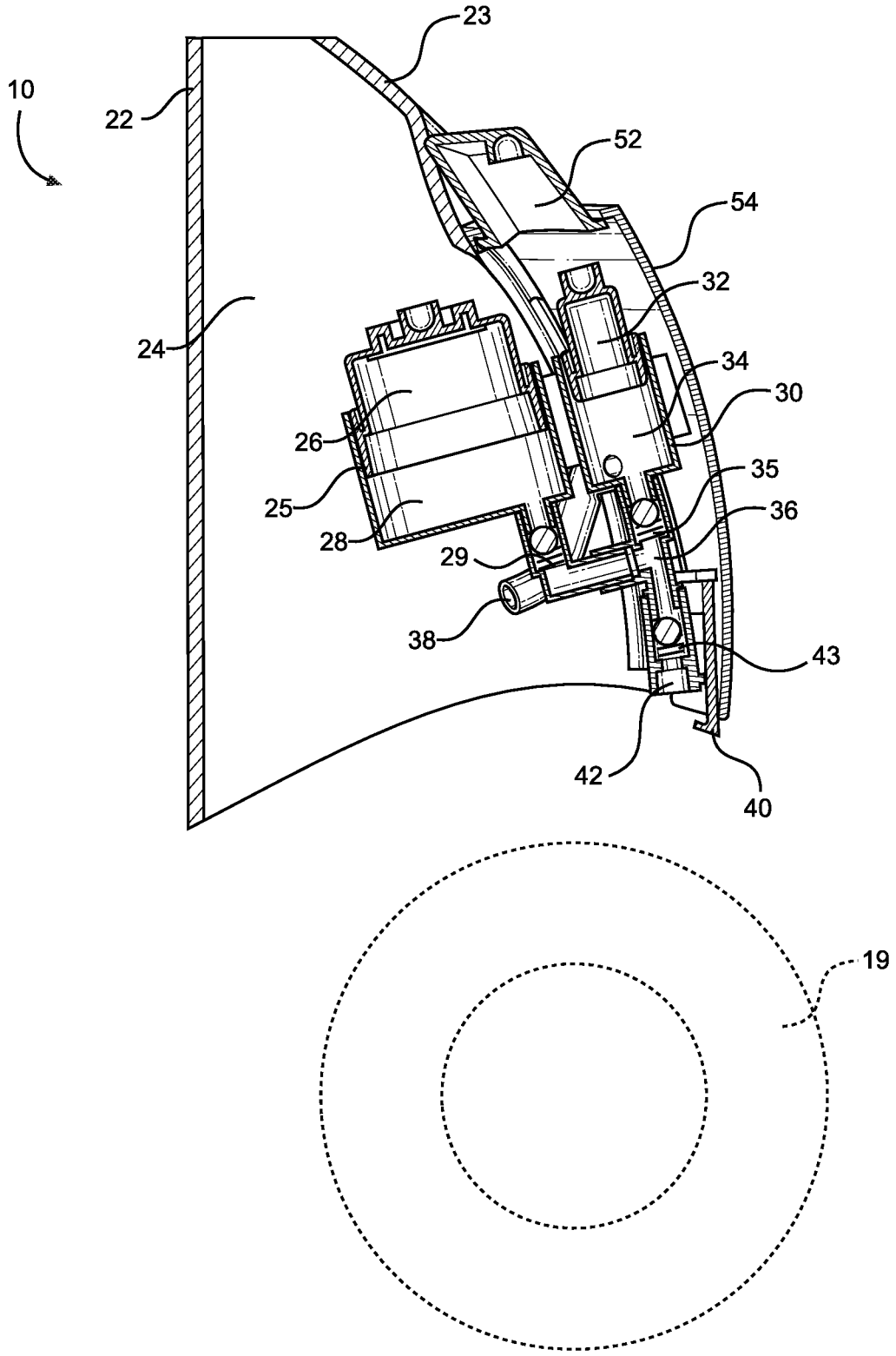
FIG. 2A shows a cross sectional view of an embodiment of the solution dispensing device with the actuator in a starting position.
Figure 2B:
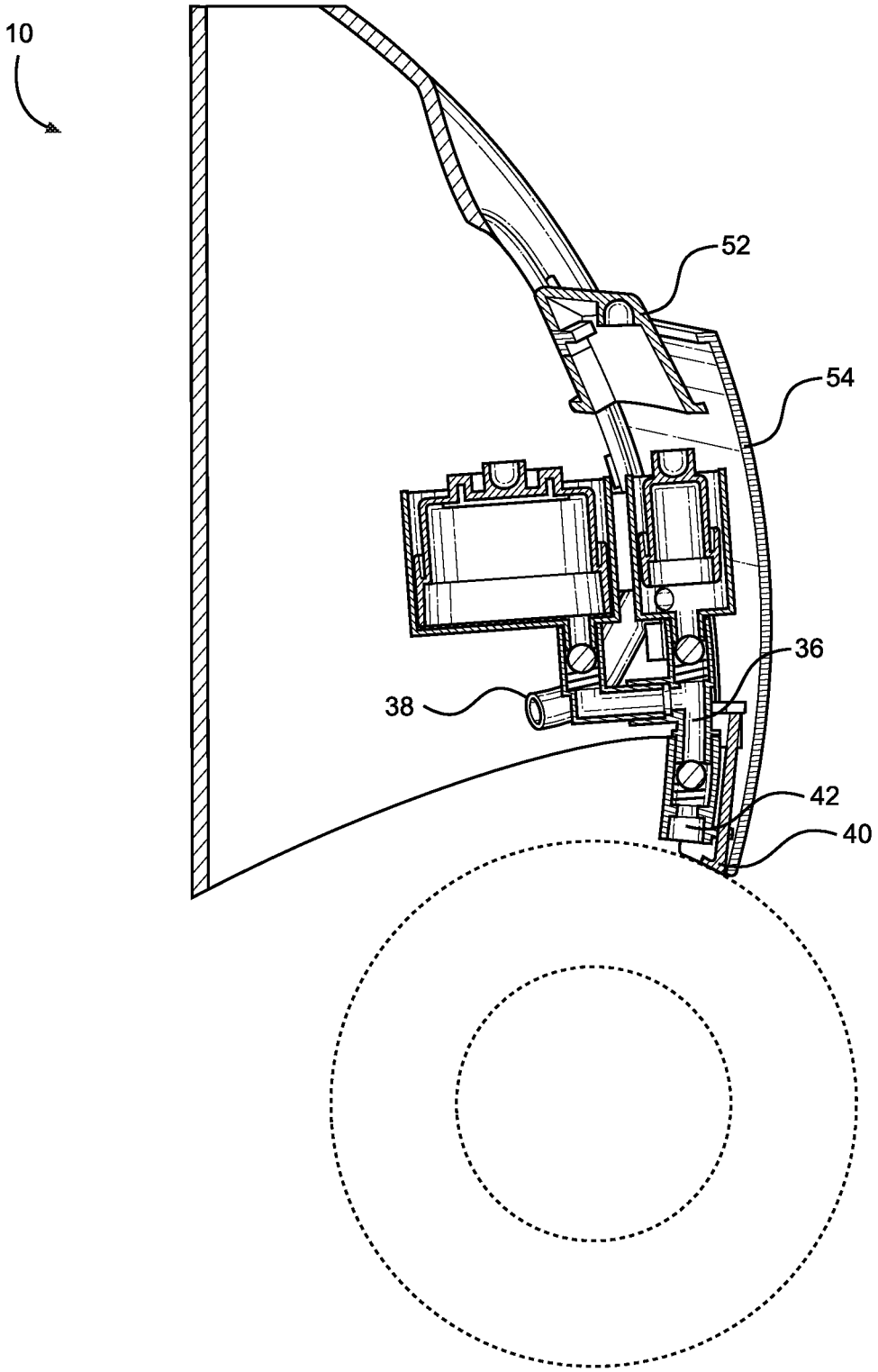
FIG. 2B shows a cross sectional view of an embodiment of the solution dispensing device with the actuator in a dispensing position.

Referring now to FIGS. 1, 2A and 2B, there is shown a perspective view of the solution dispensing device, a cross sectional view of the solution dispensing device with the actuator in a starting position, and a cross sectional view of the solution dispensing device with the actuator in a dispensing position, respectively. The solution dispensing device 10 comprises a housing 20 having an interior volume forming a solution reservoir 24. An actuator 54 is disposed on a front wall 23 of the housing 20. The actuator 54 is slidably connected to a front wall 23 of the solution dispensing device 10. This will allow the actuator 54 to slide from a starting position to a dispensing position. The actuator 54 is operably connected to a solution chamber 30. The actuator 54 is configured to move between a starting position, as shown in FIG. 2A, to a dispensing position, as shown in FIG. 2B. In some embodiments, the actuator 54 is actuated via operation of a push button 52, while in other embodiments the actuator is operably connected to a motion sensor and is actuated when nearby motion is detected. The housing 20 may be configured to be mounted onto a vertical surface, such as a wall. A mounting bracket or similar mechanism may be provided on a rear surface of the housing 22 for mounting purposes. Furthermore, some embodiments of the solution dispensing device allow for mounting with a flat mount toilet paper holder, while further embodiments are configured to adapt to a recess mounted toilet paper holder.

In some embodiments of the solution dispensing device 10, the solution chamber 30 is configured similar to a piston, having a plunger 32 inserted within a housing having an interior volume 34, where the housing has a first inlet 38 and a first outlet 35. The first inlet 38 is in fluid communication with the solution reservoir 24 and is configured to draw solution stored therein into the housing of solution chamber 30 when the actuator 54 moves from a dispensing position to a starting position. The first outlet 35 is fluid communication with a dispensing passageway 36.

A trigger 40 is disposed adjacent to the dispensing passageway 36 and is operably attached thereto. When the actuator 54 is engaged, the trigger 40 is lowered toward a targeted material, such as a paper good source. For example, a toilet paper roll 19 may be suspended below the housing 20 of the solution dispensing device 10. The trigger 40 includes a sensor that is configured to release the contents of the solution chamber 30 when a surface of the targeted material is detected. In one embodiment, the trigger operates as a mechanical sensor. Thus, when the actuator 54 is engaged and the trigger 40 senses the targeted material, the trigger 40 causes the solution chamber 30 to release a predetermined amount of solution onto the targeted material through the dispensing passageway 36 via an exit outlet 42.

In some embodiments, the solution dispensing device 10 further comprises an air chamber 25 comprising a housing having an interior volume 28 with a second outlet 29, where the second outlet 29 is in fluid communication with the dispensing passageway 36. In some embodiments, the air chamber 25 is disposed within the interior volume 24 of the housing 20 of the solution dispensing device 10. In some embodiments, the air chamber 25 is connected to the actuator 54.

In some embodiments, the air chamber 25 is larger than the solution chamber 30. The varying sizes will adjust the air to solution ratio when the solution is pumped from the solution dispensing device 10. The larger the air chamber 25 is in relation to the solution chamber 30, the more bubbles will be created. This will make the solution better suited to be placed on a paper product because the paper product will not dampen entirely and absorb the solution. In one embodiment, the air chamber 25 may be three times larger than the solution chamber 30. In another embodiment, the air chamber 25 is four times larger than the solution chamber 30. In other embodiments, the ratios can change to make the solution of a desired consistency.

In such embodiments, the trigger 40 is configured to release both the predetermined volume of solution from the solution chamber 30 as well as a predetermined volume of air from the air chamber 25 into the mixing passageway 36 when the actuator 54 is engaged and the trigger 40 detects the surface of the targeted material. As the mixture of air and solution combine, air bubbles are introduced in order to create a foam product that can be dispensed on certain paper goods, such as toilet paper, without causing the paper good to disintegrate.

In further embodiments of the solution dispensing device 10, a screen 43 is disposed within the dispensing passageway 36 in order to control the amount and size of air bubbles introduced to the solution. The screen 43 may be provided in various sizes in order to create the most efficient foaming mechanism for various solutions. In other embodiments there are a plurality of screens 43. In one embodiment, the apertures of the screens 43 gradually decrease in size in order to gradually decrease the bubble sizes as the solution is pushed through the screens 43.

Referring now to FIG. 6, there is shown a cross sectional view of an embodiment of the solution dispensing device. In this view of the solution dispensing device 10 there is seen a different embodiment of the solution reservoir 24. The solution reservoir 24 in this embodiment is a compartment located in the top of the solution dispensing device 10. This solution reservoir 24 is capable of being refilled via a top door 601 in the solution dispensing device 10. The solution reservoir 24 is fluidly connected to the solution chamber 30 via a solution hose 602. The solution hose 602 is capable of extending and retracting. In one embodiment, the solution hose 602 is a coiled hose.

In this embodiment, a chamber housing 603 connects the solution chamber 30 and the air chamber 25 to the actuator 54. The chamber housing 603 will allow the solution chamber 30 and the air chamber 25 to move in concert with the actuator 54. By allowing the solution chamber 30 and the air chamber 25 to move within the actuator, it is ensured that the solution is only dispensed at the proper time.

The push button 52 is slidably attached to the top side of the actuator 54. The push button 52 is capable of moving from a resting position to a depressed position. The push button 52 will only be able to enter the depressed position once the actuator 54 is locked into place. The push button 52 is connected to the plunger 26 of the air chamber 25 and the plunger 32 of the solution chamber 30. The connection is done in such a manner that both plungers 26, 32 are pressed at the same time.

Figure 7:
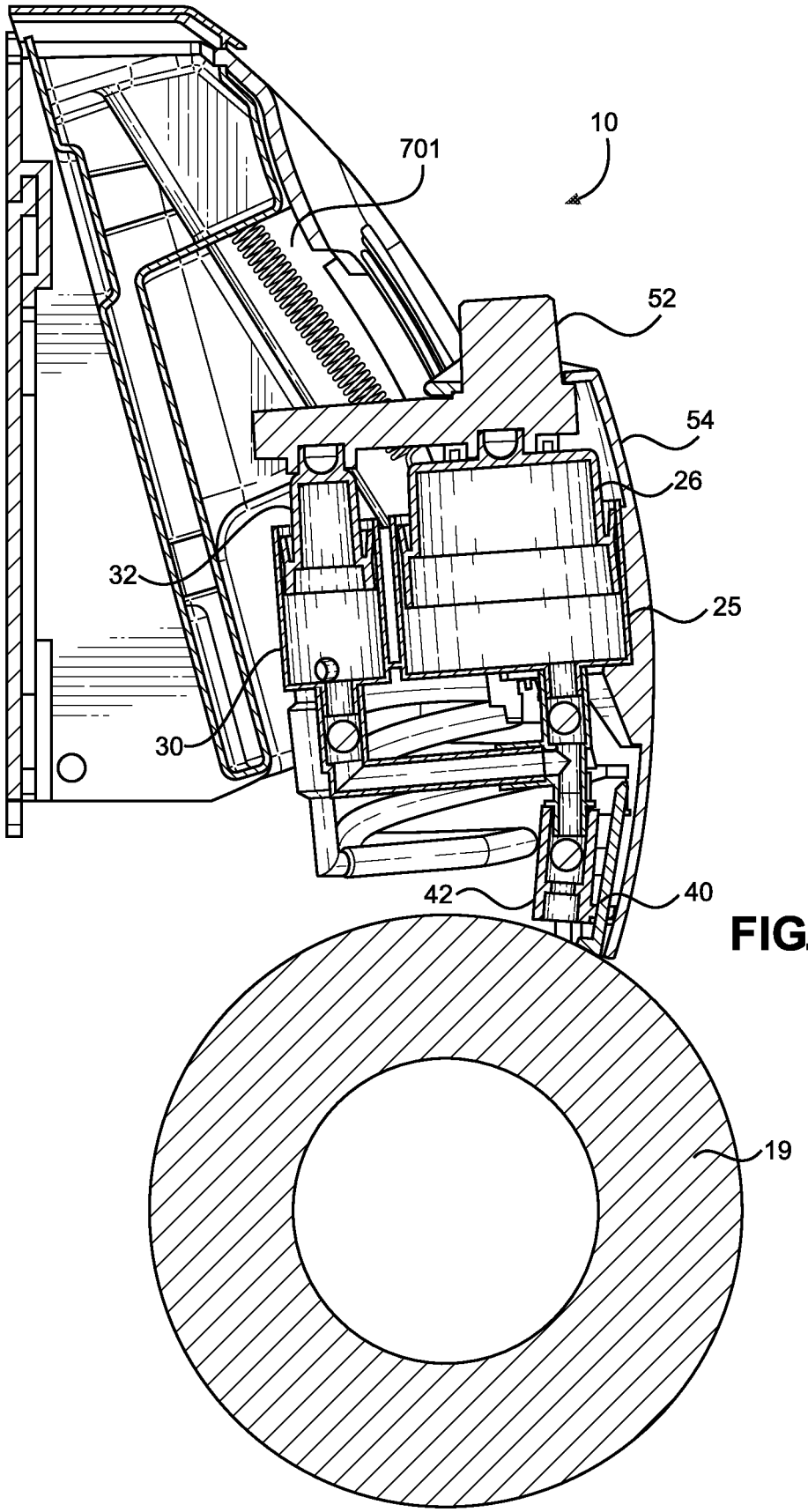
FIG. 7 shows a cross sectional view of an embodiment of the solution dispensing device with the actuator in a lowered position.

Referring now to FIG. 7, there is shown a cross-sectional view of an embodiment of the solution dispensing device with the actuator in a lowered position. There can be seen a biasing spring 701. The biasing spring 701 is strong enough to hold the actuator 54 in a resting position. The biasing spring 701 will allow the push button 52 to be used to move the actuator 54 from the resting position without pressing the plungers 26, 32. The biasing spring 701 will allow the actuator 54 to go from a resting position to a dispensing position.

Figure 9:
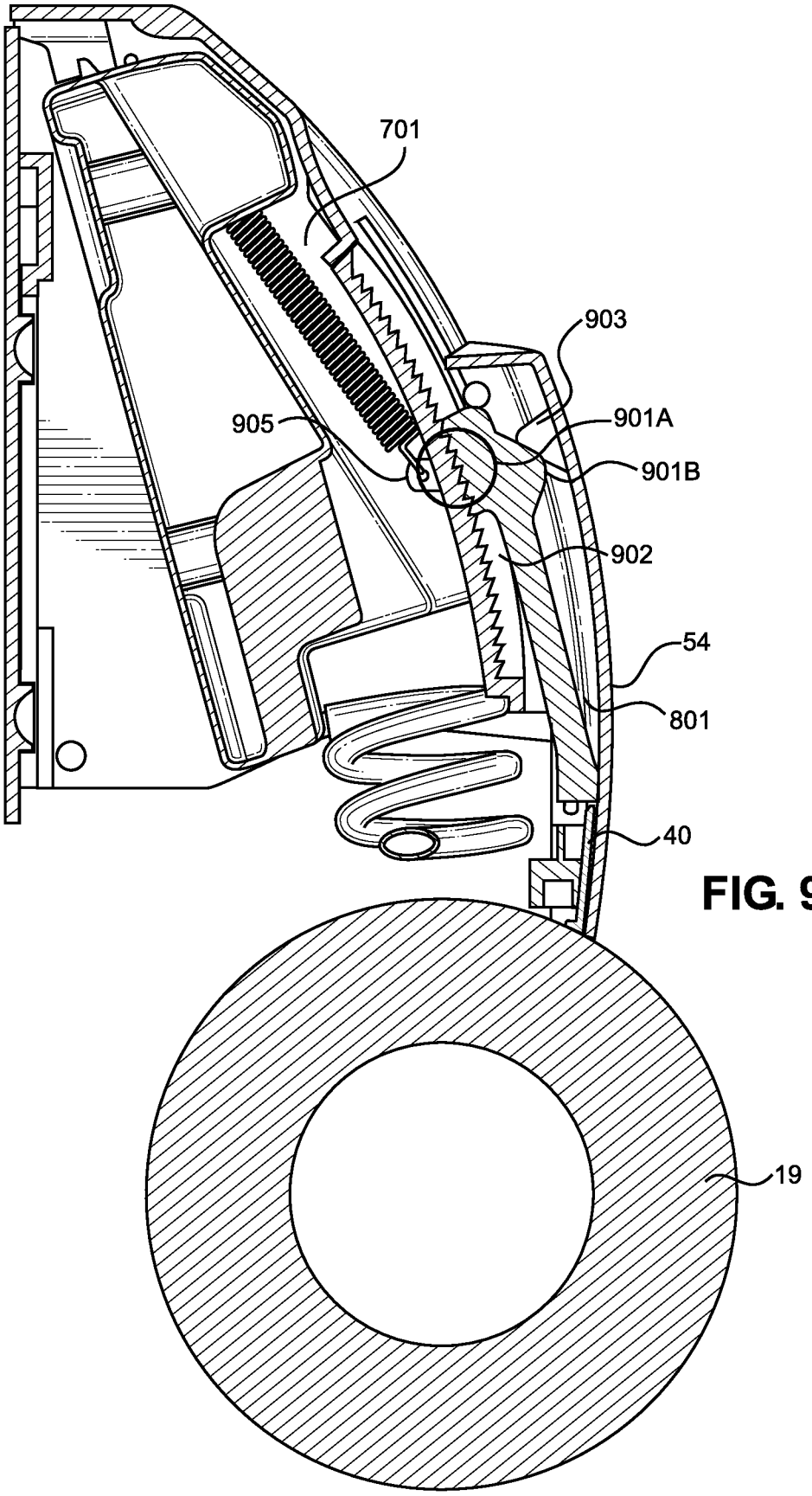
FIG. 9 shows a different cross sectional view of an embodiment of the solution dispensing device displaying how the trigger locks the actuator in place.

In the dispensing position, the trigger 40 will be engaged. The trigger 40 is slidably connected to and positioned partially within the actuator 54. When the actuator 54 is moved to a dispensing position the trigger 40 will, in one embodiment, contact the paper good source 19. In other embodiments, other surfaces may be contacted. When the trigger 40 contacts the paper good source 19, the trigger 40 will be moved further into the actuator 54. This will cause the actuator 54 to become locked in place and not move further. For example, FIG. 9 depicts how the actuator 54 is locked in place.

Once the actuator 54 is locked in place in the dispensing position, the exit outlet 42 will be positioned overtop the paper good source 19. The exit outlet 42 will be located close enough to the paper good source 19 that the solution will be deposited onto the paper good source 19. By creating a foam from the solution, the solution will take longer to sink into the paper good source 19. This means that the integrity of the paper good source will be held intact longer.

Figure 8:
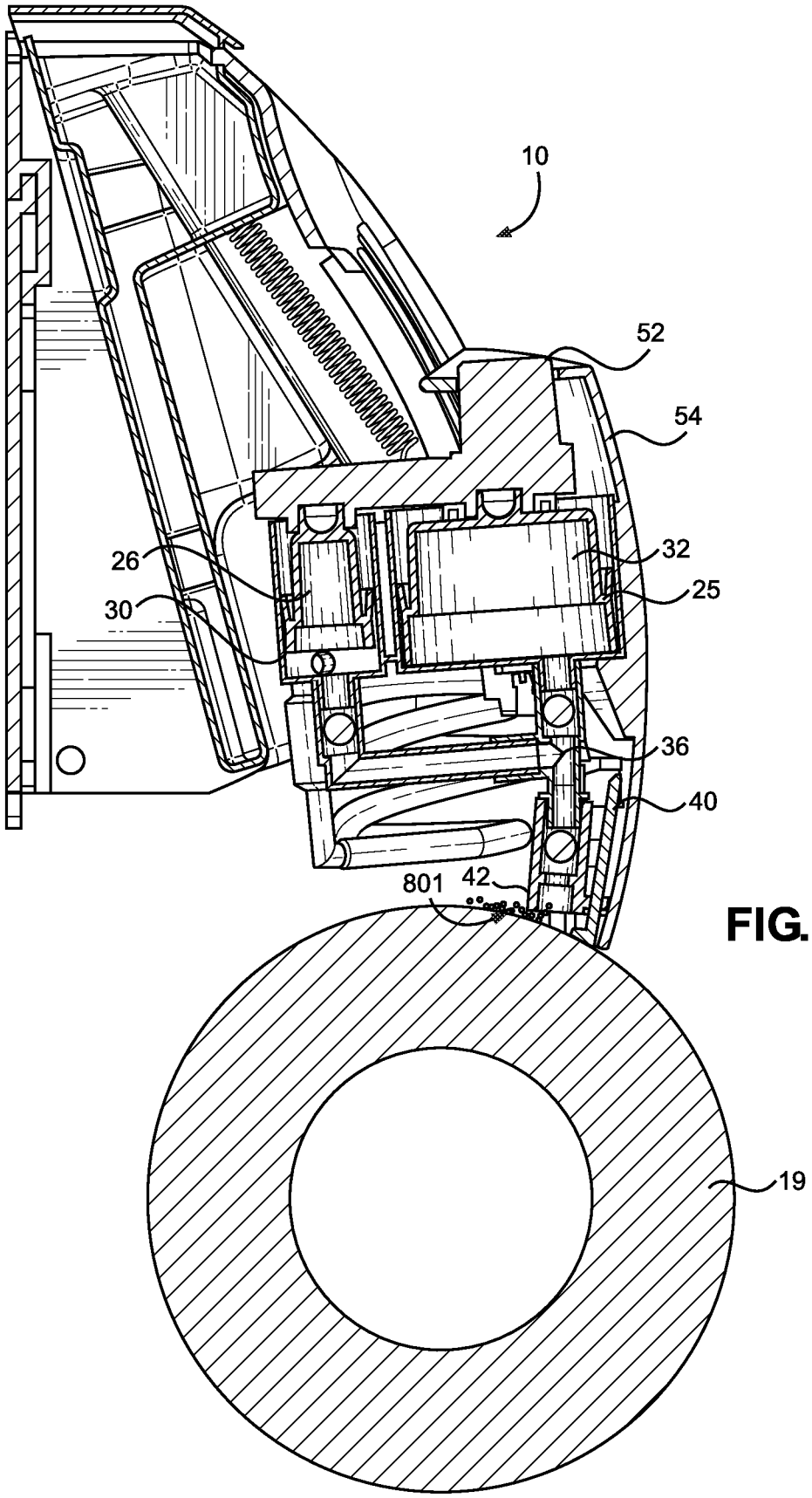
FIG. 8 shows a cross sectional view of an embodiment of the solution dispensing device with the actuator and the push button in a lowered position.

Referring now to FIG. 8, there is shown a cross sectional view of an embodiment of the solution dispensing device with the actuator and the push button in a lowered position. Once the trigger 40 is activated and the actuator 54 is locked in the dispensing position the push button 52 will then be depressed into the actuator 54. The push button 52 is slidably connected to the actuator 54 such that it can be depressed into the actuator 54. When the push button 52 is pressed into the actuator 54 it will force the plungers 26, 32 into the solution chamber 30 and the air chamber 25, respectively.

The plungers 26, 32 are configured to force the solution and the air from the chambers 25, 30 and into the dispensing passageway 36. There the solution will be infused with the air creating a bubbly foam. The foam will then be forced toward the exit outlet. In some embodiments the solution will pass through a screen as shown and described in FIG. 2A. The solution will then exit the solution dispensing device 10 via the exit outlet 42. The solution will be dispensed onto the paper good source 19.

Once the solution is dispensed the push button 52 is released, returning the actuator 54 and the plungers 26, 32 to the original starting position. As the plungers 26, 32 return to the resting position, they draw solution and air into the solution and air chambers 25, 30 respectively. The trigger 40 will further slide out of the actuator 54 and return to the resting position. This will reset the solution dispensing device 10.

Referring now to FIG. 9, there is shown a different cross-sectional view of an embodiment of the solution dispensing device displaying how the trigger locks the actuator in place. In this image, the biasing spring 701 can be seen clearly attached to the actuator 54. The actuator 54 has an attachment device 905 attached thereto. In this image, the biasing spring 701 is holding the actuator 54 in a resting position.

The actuator 54 further holds a locking device 901. The locking device 901 is slidably disposed within the actuator 54. The locking device 901 is an elongated bar with an enlarged head 901*b*. The enlarged head 901*b* has a set of locking teeth 901*a* cut therein. The locking teeth 901*a* are configured to mesh with a set of opposite locking teeth 902 located on the dispensing device 10.

When the trigger 40 is activated, it pushes the locking bar 901 into the actuator 54. The actuator 54 has a block 903 that engages with the enlarged head 901*b*. The enlarged head 901*b* will be pushed toward the locking teeth 902 located on the dispensing device 10. The locking teeth 901*a* located on the enlarged head 901*b* will engage with the locking teeth 902 located on the dispensing device 10. This will lock the actuator 54 in a dispensing position where it cannot move any further in a dispensing direction.

The solution that may be used with the solution dispensing device 10 can include various soaps or alternative solvents. For example, a B100 biodiesel with solvent cleansing properties may be used within the solution dispensing device 10 and aerated with air, allowing for an effective and environmentally-friendly method of added solvent properties to a targeted material such as a paper good. A regular disinfecting soap can be used in this solution dispenser 10. Measured quantity of solutions with a varying percent of ingredients for varied cleaning purposes, example hand cleaning, countertops such as *salmonella, E coli*, example glass and stainless steel. Additional solutions dispensed with this dispenser may contain extreme foaming agents, so as to create a foam lather, with the ability to sit on top of the paper source, and not let water permeate into the paper source for a said period of time. The regular soap will be filled with air and can be used in a manner similar to traditional hand sanitizer. Traditional soaps work better than traditional hand sanitizers in most cases. With this dispenser the soaps will not have to be washed off with water and will be able to be more accommodating and easier to have access to.

Figure 3:
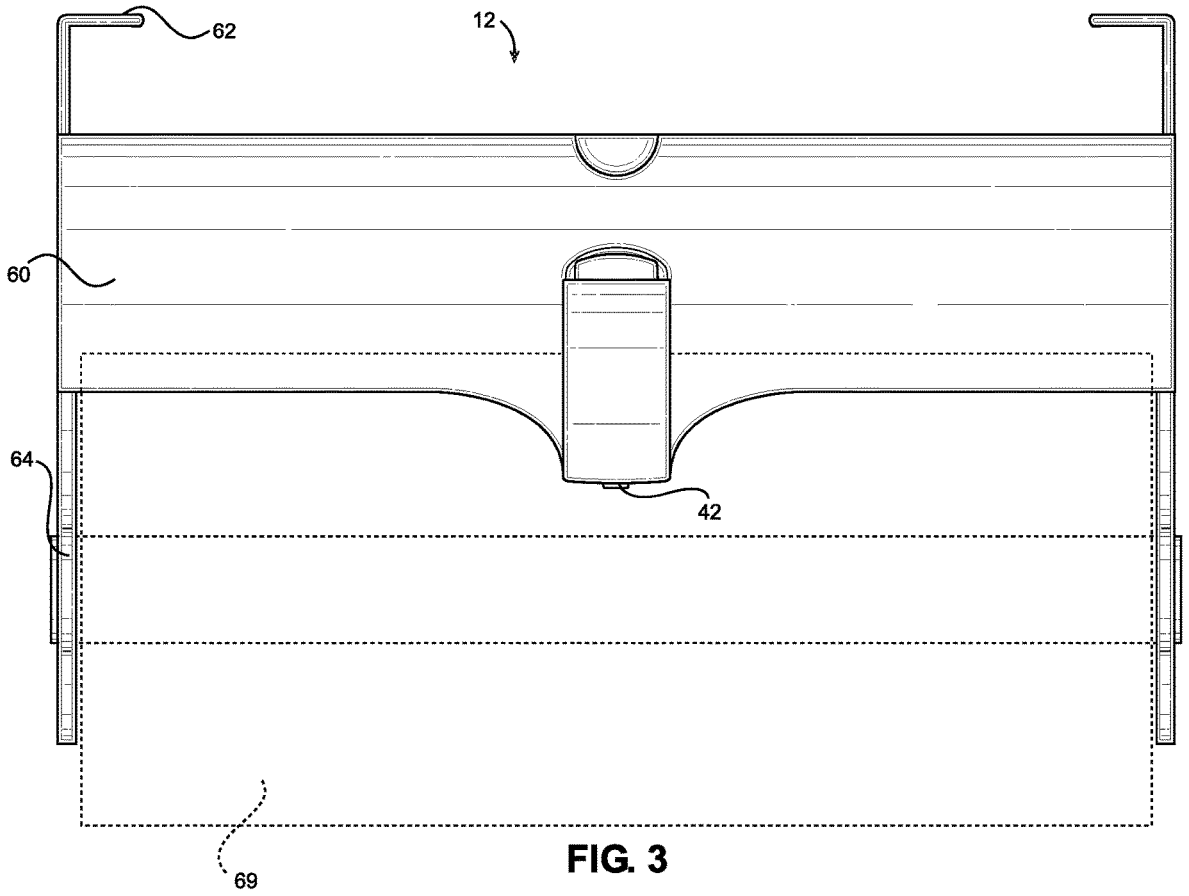
FIG. 3 shows a front view of an alternative embodiment of the solution dispensing device adapted for use with a paper towel roll.

Referring now to FIG. 3, there is shown a front view of an alternative embodiment of the solution dispensing device adapted to use with a paper towel roll. In some embodiments of the solution dispensing device 12, the housing 60 is adapted to be mounted to the underside of a cabinet. Appropriate mounting brackets 62 for installing on a lower surface may be provided and secured to the housing 60. Additionally, the housing 60 includes support arms 64 configured to hold a paper towel roll 69. The support arms 64 may extend below the housing 60 and are configured to hold the paper towel roll 69 directly below the exit outlet 42.

Figure 4:
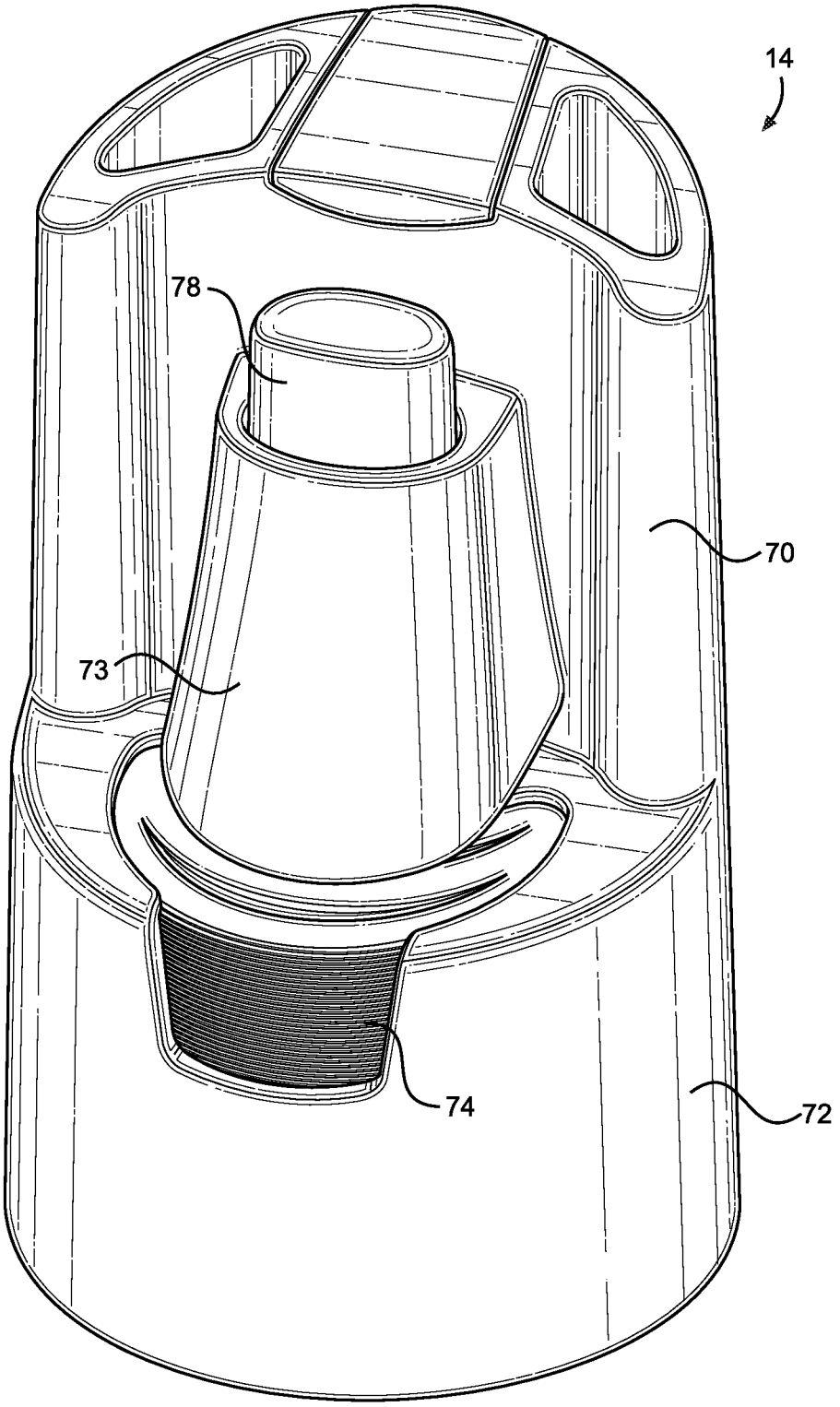
FIG. 4 shows a perspective view of a further embodiment of the solution dispensing device adapted for use with cosmetic cleansing pads.
Figure 5A:
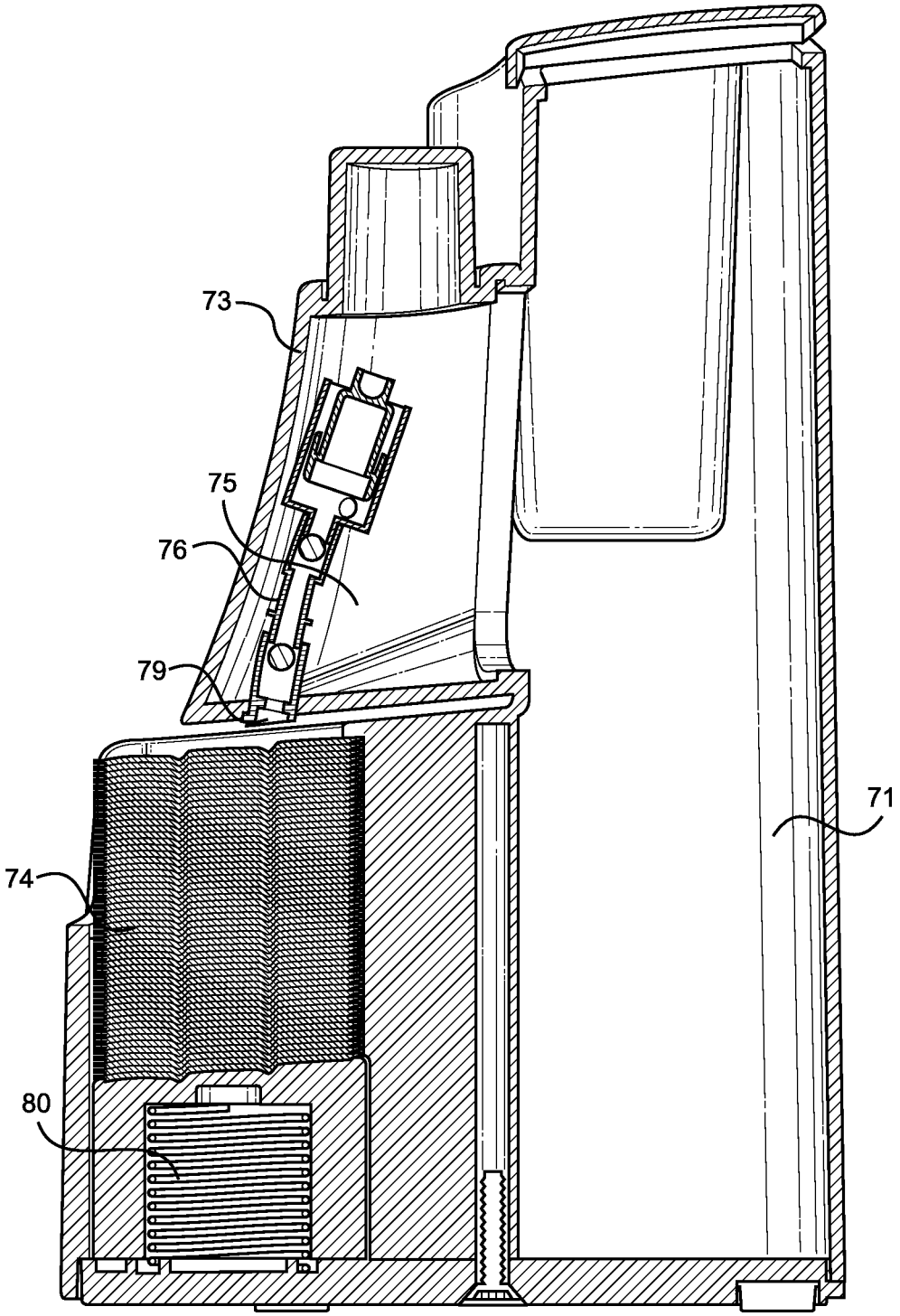
FIG. 5A shows a cross sectional view of an embodiment of the solution dispensing device adapted for use with cosmetic cleansing pads showing a stack of cosmetic cleansing pads.
Figure 5B:
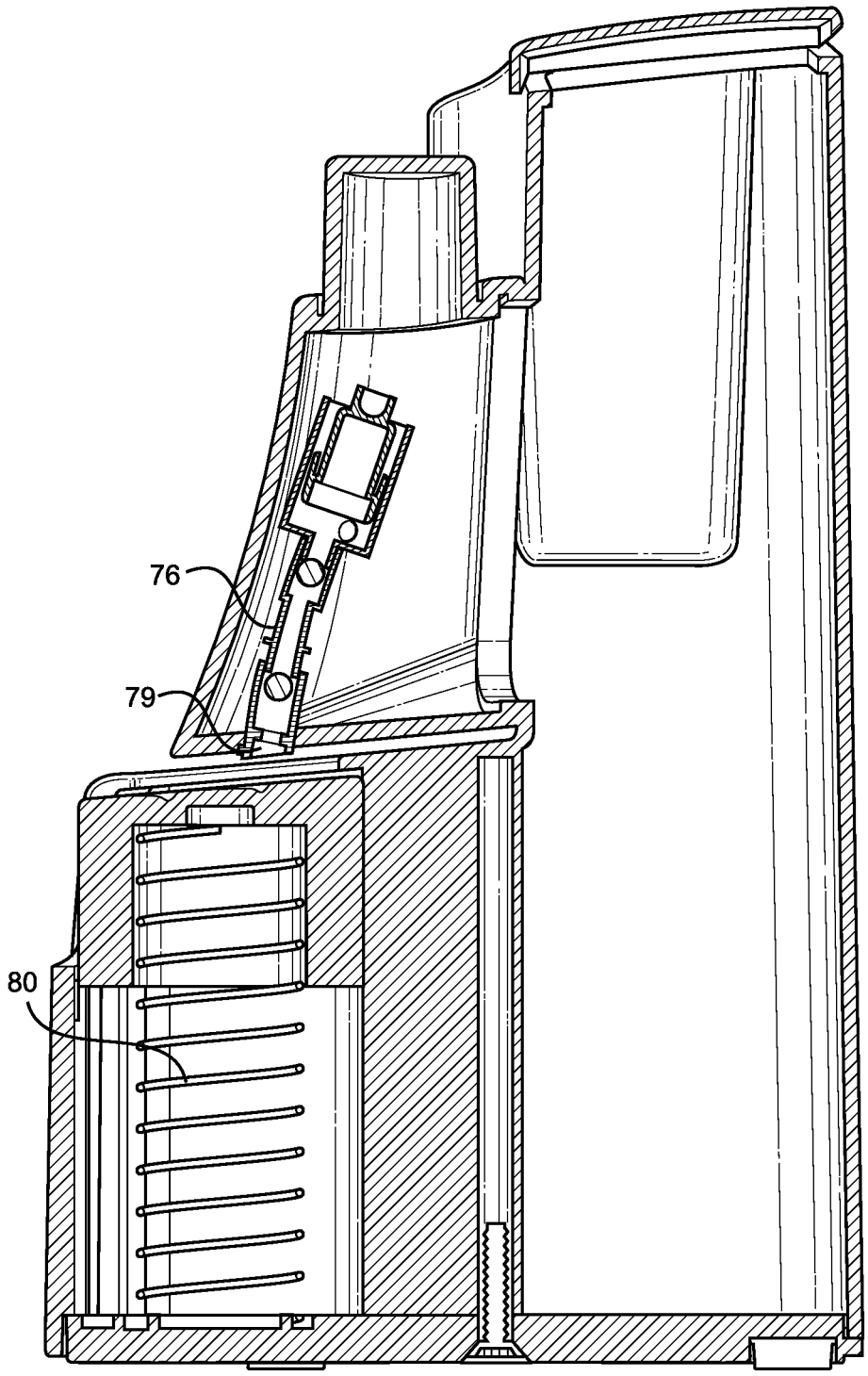
FIG. 5B shows a cross sectional view of an embodiment of the solution dispensing device adapted for use with cosmetic cleansing pads.

Referring now to FIGS. 4, 5A and 5B, there is shown a perspective view of a further embodiment of the solution dispensing device adapted for use with cosmetic cleansing pads, a cross sectional view of the solution dispensing device adapted for use with cosmetic cleansing pads showing a stack of cosmetic cleansing pads, and a cross sectional view of the solution dispensing device adapted for use with cosmetic cleansing pads, respectively. In the depicted embodiments, the housing 14 is configured to be placed on a planar horizontal surface, such as a counter or the upper surface of a dresser. The housing 14 of the solution dispensing device includes a base 72 and an upstanding section 70. A spring 80 is disposed within the base, and a solution reservoir 81 is disposed within the solution housing 73. A solution chamber 76 is secured within the solution housing 73 and in fluid communication with a solution reservoir 75.

A stack of cosmetic cleansing pads 74 are placed below the exit outlet 79 of the mixing passageway. In some embodiments, the cosmetic cleansing pads 74 are placed directly above a spring 80 that is configured to bias them toward the exit outlet 79. In operation, a user engages the actuator 78 to release the solution onto the cleansing pad 74.

In some embodiments, the cleansing pads include reinforced pads, allowing for extended use even when impregnated with solution dispensed thereon. Additional embodiments include solution dispensing devices adapted for use with diaper wipes in the place of cosmetic cleansing pads.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A solution dispensing device, comprising:

a housing having an interior volume comprising a solution reservoir;

an actuator body movably mounted to the housing, wherein the actuator is operably connected to a dispensing assembly, the dispensing assembly comprising a solution chamber having an interior volume with a first inlet and a first outlet, the first outlet in fluid communication with a dispensing passageway;

wherein the solution chamber is disposed within the actuator body;

wherein the actuator body is configured to be movable between a starting position and a dispensing position, wherein the actuator body is slid towards a surface of a targeted material positioned adjacent the dispensing passageway when in the dispensing position;

a material sensing trigger connected to the actuator body that is configured to sense the targeted material by pressing against the targeted material;

wherein the material sensing trigger is further configured to allow a predetermined amount of solution to be dispensed onto the targeted material through the dispensing passageway.

2. The solution dispensing device of claim 1, where the trigger is further configured to prevent the predetermined amount of solution from dispensing if no target material is detected.

3. The solution dispensing device of claim 1, wherein the material sensing trigger is locked in the starting position and unlocked in the dispensing position.

4. The solution dispensing device of claim 1, wherein the housing is adapted to be mounted onto a planar vertical surface.

5. The solution dispensing device of claim 1, wherein the housing is adapted to be mounted with a flat mount toilet paper holder.

6. The solution dispensing device of claim 1, wherein the housing is adapted to be mounted with a recessed toilet paper holder.

7. The solution dispensing device of claim 1, further comprising:

an air chamber comprising a housing having an interior volume with a second outlet, the second outlet in fluid communication with the dispensing passageway, the air chamber configured to release a predetermined volume of air into a mixing passageway when the actuator is engaged and the material sensing trigger detects a target material.

8. The solution dispensing device of claim 7, wherein the air chamber is disposed within the housing.

9. The solution dispensing device of claim 7, wherein the predetermined volume of air is configured to impregnate the predetermined amount of solution with air bubbles as the solution leaves the mixing passageway via an exit outlet.

10. The solution dispensing device of claim 7, further comprising an aeration screen disposed in the mixing passageway adjacent to the exit outlet.

11. The solution dispensing device of claim 1, further comprising a paper good source.

12. The solution dispensing device of claim 11, wherein the paper good source comprises a roll of paper.

13. A solution dispensing device comprising:

a movable housing including an actuator, wherein the actuator is slidably connected to the movable housing;

the actuator comprising a dispensing button located at a top side of the movable housing;

a sensing trigger attached to a lower side of the movable housing, the sensing trigger configured to press inward toward a locking track once pressed against a material, wherein the movable housing will no longer move in a downward direction;

the dispensing button configured to press further down into the movable housing once the sensing trigger has locked the housing in place;

wherein the dispensing button is connected to a top of an air chamber and a solution chamber located within the moveable housing;

wherein the air chamber and the solution chamber are configured to compress and dispel solution when the dispensing button is pressed into the movable housing.

14. The solution dispensing device of claim 13, wherein the air chamber is larger than the solution chamber.

15. The solution dispensing device of claim 13, further comprising a solution reservoir located within the housing.

16. The solution dispensing device of claim 15, wherein the solution chamber is fluidly connected to the solution reservoir.

17. The solution dispensing device of claim 13, further comprising a solution dispensing port located at the bottom of the actuator.

18. The solution dispensing device of claim 17, wherein the solution chamber and the air chamber are fluidly connected to the dispensing port.

19. The solution dispensing device of claim 18, further comprising a mixing area where the air from the air chamber and the solution from the solution chamber are mixed together before being dispensed.

20. The solution dispensing device of claim 18, further comprising screens configured to form a plurality of air bubbles within the solution.

* * * * *